US009309827B2

(12) United States Patent
Kitamura et al.

(10) Patent No.: US 9,309,827 B2
(45) Date of Patent: Apr. 12, 2016

(54) FUEL INJECTION CONTROL DEVICE FOR SADDLE-RIDE TYPE VEHICLE

(71) Applicant: HONDA MOTOR CO., LTD., Tokyo (JP)

(72) Inventors: Takahiro Kitamura, Wako (JP); Kotaro Miki, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 320 days.

(21) Appl. No.: 13/956,485

(22) Filed: Aug. 1, 2013

(65) Prior Publication Data

US 2014/0060491 A1 Mar. 6, 2014

(30) Foreign Application Priority Data

Aug. 29, 2012 (JP) ..... 2012-189190

(51) Int. Cl.

| | |
|---|---|
| ***F02D 41/32*** | (2006.01) |
| ***F02D 41/34*** | (2006.01) |
| ***F02D 41/00*** | (2006.01) |
| ***F02D 41/10*** | (2006.01) |
| *F02D 41/04* | (2006.01) |

(52) U.S. Cl.

CPC ..... *F02D 41/32* (2013.01); *F02D 41/0097* (2013.01); *F02D 41/10* (2013.01); *F02D 41/34* (2013.01); *F02D 41/045* (2013.01); *F02D 2250/12* (2013.01); *F02D 2250/14* (2013.01)

(58) Field of Classification Search

CPC ... F02D 41/0097; F02D 41/045; F02D 41/10; F02D 41/32; F02D 2250/12; F02D 2250/14

USPC ..... 123/399, 436; 73/114.26, 114.36

See application file for complete search history.

(56) References Cited

U.S. PATENT DOCUMENTS

| | | | | |
|---|---|---|---|---|
| 6,915,767 | B2 * | 7/2005 | Pfeiffer | F01L 1/34 123/90.15 |
| 7,637,249 | B2 * | 12/2009 | Yamamura | F02D 41/009 123/406.58 |
| 7,769,528 | B2 * | 8/2010 | Kawakita | F02D 41/047 123/346 |
| 7,921,698 | B2 * | 4/2011 | Omuro | G01M 15/06 73/114.26 |

(Continued)

FOREIGN PATENT DOCUMENTS

| | | |
|---|---|---|
| CA | 2644067 A1 | 6/2009 |
| EP | 1972770 A1 | 9/2008 |

(Continued)

OTHER PUBLICATIONS

Office Action mailed Jul. 29, 2015, issued in corresponding JP Patent Application No. 2012-189190.

*Primary Examiner* — Stephen K Cronin
*Assistant Examiner* — Kevin R Steckbauer
(74) *Attorney, Agent, or Firm* — Squire Patton Boggs (US) LLP

(57) ABSTRACT

A fuel injection control device includes a throttle opening read timing setter that sets the timing at which a throttle opening is read. The setter is triggered to detect the throttle opening used for calculation of a basic injection amount by the start of calculation timing of the basic injection amount (FICAL) if the FICAL is at the position corresponding to a toothless part of a crank pulsar rotor. The setter detects the throttle opening based on crank pulse interrupt according to a crank pulse if the FICAL is at a position other than the position corresponding to the toothless part.

8 Claims, 9 Drawing Sheets

(56) References Cited

U.S. PATENT DOCUMENTS

| | | | | |
|---|---|---|---|---|
| 8,055,433 | B2 * | 11/2011 | Omuro | F02D 41/0097 701/104 |
| 8,626,416 | B2 * | 1/2014 | Miki | B60K 28/16 701/85 |
| 8,826,885 | B2 * | 9/2014 | Asada | F02D 11/106 123/399 |
| 2003/0084889 | A1 * | 5/2003 | Skinner | F02P 3/02 123/609 |
| 2005/0028770 | A1 * | 2/2005 | McCabe | F01L 1/022 123/90.17 |
| 2009/0157279 | A1 * | 6/2009 | Omuro | F02D 41/0097 701/103 |
| 2012/0016569 | A1 * | 1/2012 | Asada | F02D 11/106 701/104 |
| 2014/0060491 | A1 * | 3/2014 | Kitamura | F02D 41/0097 123/478 |

FOREIGN PATENT DOCUMENTS

| | | | |
|---|---|---|---|
| EP | 1975397 | A1 | 10/2008 |
| EP | 2093404 | A2 | 8/2009 |
| EP | 2407653 | A2 | 1/2012 |
| JP | 2006-233769 | A | 9/2006 |
| JP | 4046718 | B2 | 11/2007 |
| JP | 2008-202492 | A | 9/2008 |
| JP | 2008-202493 | A | 9/2008 |
| JP | 2009-144649 | A | 7/2009 |
| JP | 2012-021458 | A | 2/2012 |

* cited by examiner

FUEL INJECTION CONTROL DEVICE FOR SADDLE-RIDE TYPE VEHICLE

BACKGROUND

1. Field

The present invention relates to fuel injection devices of saddle-ride type vehicles and particularly to a fuel injection device of a saddle-ride type vehicle capable of rapidly carrying out acceleration correction according to throttle operation.

2. Description of the Related Art

A fuel injection device of an internal combustion engine that decides the fuel injection amount based on the engine rotational speed and the throttle opening has been known in the past.

Patent Document 1 (Japanese Patent No. 4046718) discloses the following fuel injection device of the internal combustion engine. The fuel injection device detects the throttle opening at interrupt timing of a crank pulse output from a crank pulsar rotor that detects the rotation state of the crankshaft, and performs sequential injection with a basic injection amount in accordance with an injection amount map defined in advance. In addition, if the amount of time change of the throttle opening is equal to larger than a predetermined value, the fuel injection device determines that there is a request for acceleration and performs non-sequential injection with an acceleration correction amount in addition to the basic injection amount.

In the case of cornering driving on a saddle-ride type vehicle typified by the two-wheeled motor vehicle, the following driving form is taken. At the stage prior to corner entry, the vehicle body is inclined (banked) with reduction of the engine torque by brake operation, shift-down operation, and close operation of the throttle opening, to perform turn driving. Then, at the leave from the corner, the vehicle body posture is changed from the banked state to the upright state with increase in the engine torque by open operation of the throttle opening, and subsequently the vehicle speed is accelerated with shift-up operation. That is, there is a characteristic that the posture change of the vehicle body is larger than the four-wheeled vehicle. Therefore, rapid response to the throttle operation is desired.

Furthermore, regarding the two-wheeled motor vehicle, there are many demands to enjoy an acceleration feel that cannot be offered by the four-wheeled vehicle in, for example a touring ride, and rapid response to throttle open operation is desired.

However, in the case of abandoning the cam pulse rotor that detects the rotation state of the camshaft to reduce the number of parts, a stroke determination of the engine needs to be made by the crank pulsar rotor. Therefore, in the crank pulsar rotor, a toothless part of a predetermined length is formed besides protrusions disposed at substantially equal intervals. In this case, in a configuration that detects the throttle opening based on crank pulse interrupt and calculates the injection amount like in Patent Document 1, there is a problem that throttle operation cannot be detected during the passage of the toothless part and it is difficult to obtain rapid response in this transient region.

SUMMARY

An object of the present invention is to solve the problem of the above-described related art and provide a fuel injection control device in a saddle-ride type vehicle that can rapidly reflect an acceleration request of the user with the number of parts reduced as with the related art although making a stroke determination of an internal combustion engine by a crank pulse.

To achieve the above-described object, embodiments of the present invention provide a fuel injection control device of a saddle-ride type vehicle. The fuel injection control device includes a throttle opening detector that detects a throttle opening changing in conjunction with operation of a rider. A crank pulsar rotor is provided around a crankshaft and has detection-target teeth disposed at equal intervals and a toothless part. A pulse generator generates a crank pulse according to a passage state of the detection-target teeth. An engine rotational speed detector detects the crank pulse to detect the rotational speed of an engine. A fuel injector injects a fuel into an intake path of the engine. A basic injection amount calculator calculates a basic injection amount based on the engine rotational speed and the throttle opening. An additional injection amount calculator superimposes an additional injection amount on the basic injection amount based on a change amount of the throttle opening, and a calculation timing decider that decides calculation timing of the basic injection amount based on the engine rotational speed and the throttle opening. The fuel injection control device includes a throttle opening read timing setter that sets timing at which the throttle opening is read. The throttle opening read timing setter is so configured as to be triggered to detect the throttle opening used for calculation of the basic injection amount by start of the calculation timing of the basic injection amount if the calculation timing of the basic injection amount is at a position corresponding to the toothless part.

In some embodiments, the throttle opening read timing setter detects the throttle opening based on crank pulse interrupt according to the crank pulse if the calculation timing of the basic injection amount is at a position other than the position corresponding to the toothless part.

In some embodiments, the calculation timing of the basic injection amount is set to timing that is before calculation timing of the additional injection amount set in an intake stroke of the engine and is in such a range that injection with the basic injection amount is completed by start time of the calculation timing of the additional injection amount.

In some embodiments, the additional injection amount calculator sets the additional injection amount larger when the change amount of the throttle opening is larger.

In other embodiments, if the engine has at least two cylinders, the throttle opening read timing setter is triggered to detect the throttle opening by start of the calculation timing of the basic injection amount for the cylinder in which the calculation timing of the basic injection amount is at a position corresponding to the toothless part, and detects the throttle opening based on crank pulse interrupt according to the crank pulse for the cylinder in which the calculation timing of the basic injection amount is at a position other than the position corresponding to the toothless part.

The fuel injection control device can include the throttle opening read timing setter that sets the timing at which the throttle opening is read, and the throttle opening read timing setter is so configured as to be triggered to detect the throttle opening used for calculation of the basic injection amount by start of the calculation timing of the basic injection amount if the calculation timing of the basic injection amount is at the position corresponding to the toothless part. Therefore, the latest throttle opening can be detected even when the calculation timing of the basic injection amount is at the toothless position. This provides an effect that an acceleration request by the driver can be rapidly reflected without causing increase in the number of parts for example.

In certain embodiments, the throttle opening read timing setter detects the throttle opening based on the crank pulse interrupt according to the crank pulse if the calculation timing of the basic injection amount is at a position other than the position corresponding to the toothless part. Therefore, if FICAL is in the part other than the toothless part, detection of the throttle opening is triggered by input of the crank pulse, which serves as a sure input signal. This makes it possible to rapidly reflect an acceleration request whatever situation the calculation timing is in.

In some embodiments, the calculation timing of the basic injection amount is set to timing that is before the calculation timing of the additional injection amount set in an intake stroke of the engine and is set in such a range that injection with the basic injection amount is completed by start time of the calculation timing of the additional injection amount. Therefore, the calculation timing can be figured out at proper timing according to the operation state of the engine.

In certain embodiments, the additional injection amount calculator sets the additional injection amount larger when the change amount of the throttle opening is larger. Therefore, the acceleration correction amount becomes larger depending on the change amount of the throttle opening and an acceleration request by the driver can be reflected more rapidly.

If the engine has at least two cylinders, the throttle opening read timing setter is triggered to detect the throttle opening by start of the calculation timing of the basic injection amount for the cylinder in which the calculation timing of the basic injection amount is at the position corresponding to the toothless part, and detects the throttle opening based on the crank pulse interrupt according to the crank pulse for the cylinder in which the calculation timing of the basic injection amount is at a position other than the position corresponding to the toothless part. Therefore, in the engine having plural cylinders, even if the positional relationship between the calculation timing of the basic injection amount and the toothless position of the crank pulsar rotor differs for each cylinder, proper detection of the throttle opening is enabled on each cylinder basis.

DETAILED DESCRIPTION

Figure 1:
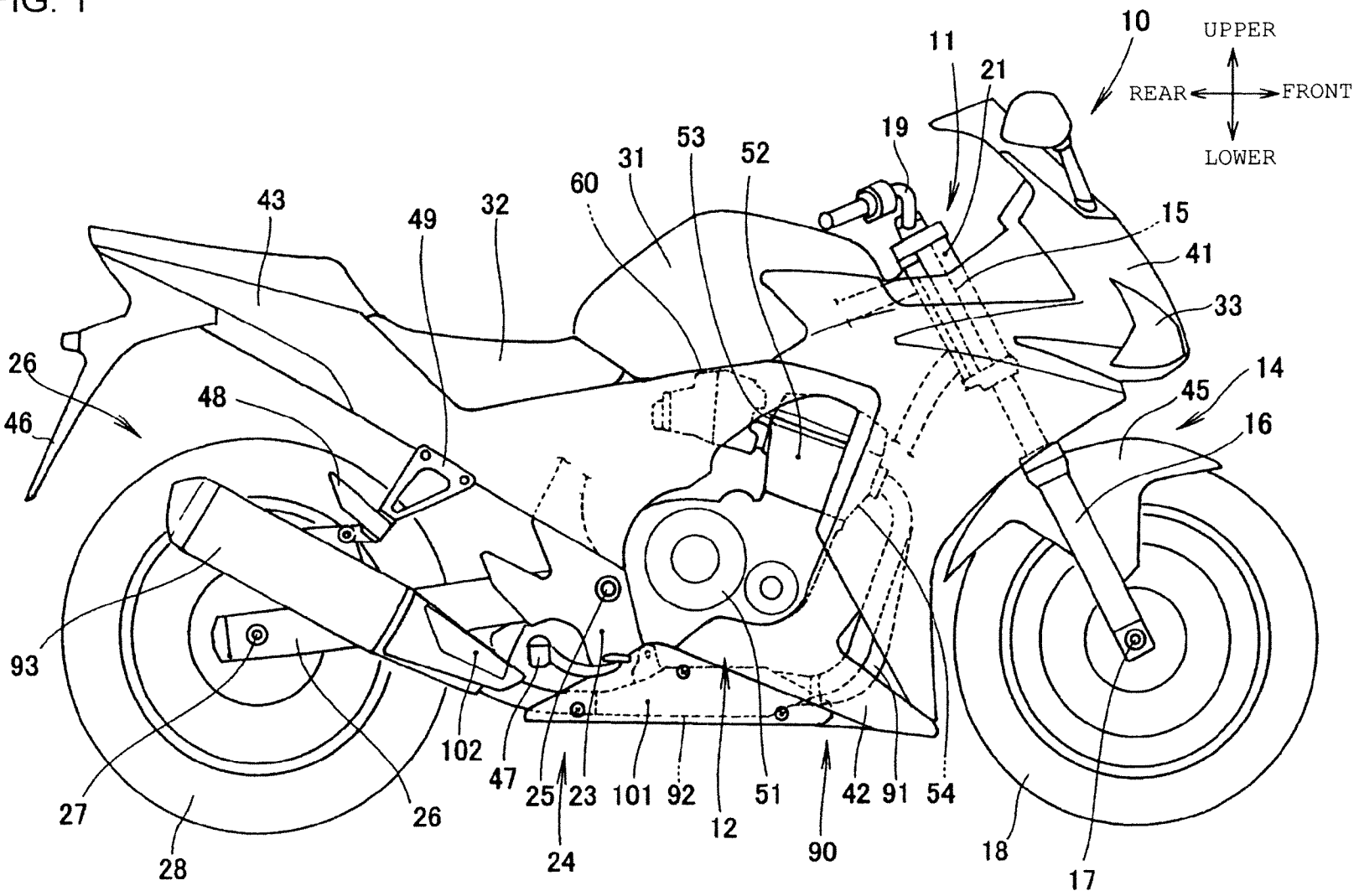
FIG. 1 is a right side view of a two-wheeled motor vehicle to which a fuel injection control device according to embodiments of the present invention is applied.

A preferred embodiment of the present invention will be described in detail below with reference to the drawings. FIG. 1 is a right side view of a two-wheeled motor vehicle 10 to which a fuel injection control device according to one embodiment of the present invention is applied. The two-wheeled motor vehicle 10 can include a vehicle body frame 11, and an engine 12 as an internal combustion engine suspended on this vehicle body frame 11. A front wheel steering unit 14 is rotatably attached to a head pipe 21 at the front end of the vehicle body frame 11. A rear wheel suspension 26 is swingably attached to a pivot frame 23 of the vehicle body frame 11, and a fuel tank 31 is attached to the vehicle body frame 11 above the engine 12. A seat 32 is disposed on the rear side of the fuel tank 31.

The front wheel steering unit 14 can be composed of a stem shaft 15 as a steering shaft, and steering handles 19 attached to the upper part of this stem shaft 15. A pair of left and right front forks 16 extend downward from the stem shaft 15, and a front wheel axle 17 is spanned along the vehicle width direction at the lower end of the front forks 16. A front wheel 18 is rotatably attached to this front wheel axle 17.

The rear wheel suspension 26 is composed of a pivot shaft 25 penetrating the pivot frame 23 along the vehicle width direction, and a swing arm 26 pivotally supported by this pivot shaft 25. A rear wheel axle 27 is spanned at the rear end of the swing arm 26, and a rear wheel 28 is attached to this rear wheel axle 27. A cushion unit (not shown) is for hanging the swing arm 26 on the vehicle body frame 11.

The front part of the vehicle body frame 11 is covered by a front cowl 41 made of a resin on which a headlight 33 is mounted. The area from the lower side of the fuel tank 31 to the lower side of the engine 12 and the lower front part of the seat 32 are covered by a mid cowl 42. The lower rear part of the seat 32 is covered by a rear cowl 43 continuously with this mid cowl 42.

A front fender 45 for blocking mud from the front wheel 18 is attached to the front forks 16 and a rear fender 46 for blocking mud from the rear wheel 28 is attached to the rear end part of the rear cowl 43. Steps 47 that make a pair in the vehicle width direction and on which the driver's feet are put are attached to the rear part of the pivot frame 23. On the rear side thereof, passenger steps 48 on which a fellow passenger at the rear seat places the feet are attached to the vehicle body with the intermediary of a stay 49.

The engine 12 is in some embodiments, a four-cycle two-cylinder engine with a crankshaft oriented along the vehicle width direction and includes a crankcase 51 and a cylinder part 52 extending from this crankcase 51 toward the obliquely front upper side of the vehicle. An intake system 60 in which the fuel injection device and a throttle valve are mounted is attached to a rear wall 53 of the cylinder part 52, and an exhaust pipe 91 of an exhaust system 90 is connected to a front wall 54 of the cylinder part 52.

The exhaust system 90 is composed of the exhaust pipe 91 extending from the engine 12, a catalyst chamber 92 interposed in the middle of the exhaust pipe 91 to purify the exhaust gas, and a muffler 93 connected to the rear end of the catalyst chamber 92. The muffler 93 is hung from the stay 49 of the passenger steps 48. The catalyst chamber 92 is covered by a protective member 101 made of a metal and the front part of the muffler 93 is covered by a decorative cover 102 made of a metal.

Figure 2:
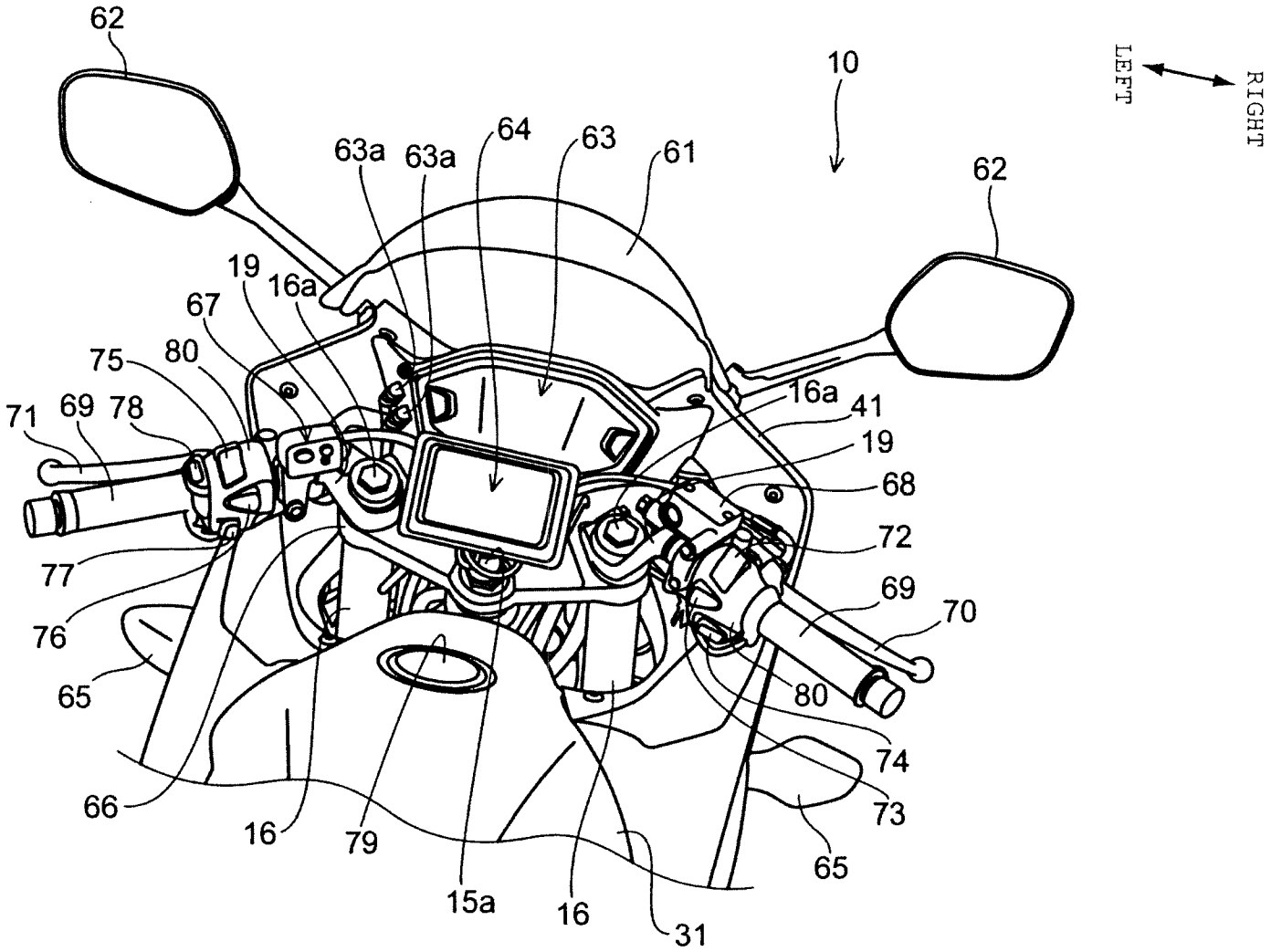
FIG. 2 is a perspective view around the handle of the two-wheeled motor vehicle.

FIG. 2 is a perspective view around the handle of the two-wheeled motor vehicle 10. The left and right front forks 16 are coupled to each other by a top bridge and the steering handles 19 are fixed to the upper parts of the front forks 16 penetrating the top bridge 66. Top caps 16*a* are attached to the upper ends of the front forks 16. A locknut 15*a* of the stem shaft 15 is attached to the center of the top bridge 66 in the vehicle width direction.

The front cowl 41 having a windbreak screen 61 is attached to the vehicle body front side of the steering handles 19 and a pair of left and right rear-view mirrors 62 are attached to the front surface side of the front cowl 41. A meter system 63 including speedometer, revolution indicator, distance meter, warning lights, etc., is disposed between the windbreak screen 61 and the top bridge 66. Operation switches 63*a* for display switching, reset of the distance meter, etc. are provided at the left end part of the meter system 63 in the vehicle width direction. To the upper part of the top bridge 66, a navigation system 64 for guiding a route with a map displayed on a screen by using the GPS satellites is attached.

To the right steering handle 19, a handle grip 69 as a throttle operating element operated by the rider, a front wheel brake lever 70, a reserve tank 68 of a hydraulic master cylinder, and right handle switches 80 are attached. In the right handle switches 80, an engine stop switch 72, a hazard lamp switch 73, and an engine starter switch 74 are provided.

To the left steering handle 19, a handle grip 69, a clutch lever 71, an operation switch 67 of the navigation system 64, and left handle switches 80 are attached. In the left handle switches, an optical axis changeover switch 75, a horn switch 76, and a blinker switch 77 are attached. An operation switch 78 of a grip heater is attached between the handle grip 69 and the handle switches 80.

The fuel tank 31 having a filler cap 79 is disposed on the vehicle body rear side of the top bridge 66. A pair of left and right front blinker units 65 are attached to the front cowl 41 on the outside of the front forks 16 in the vehicle width direction.

Figure 3:
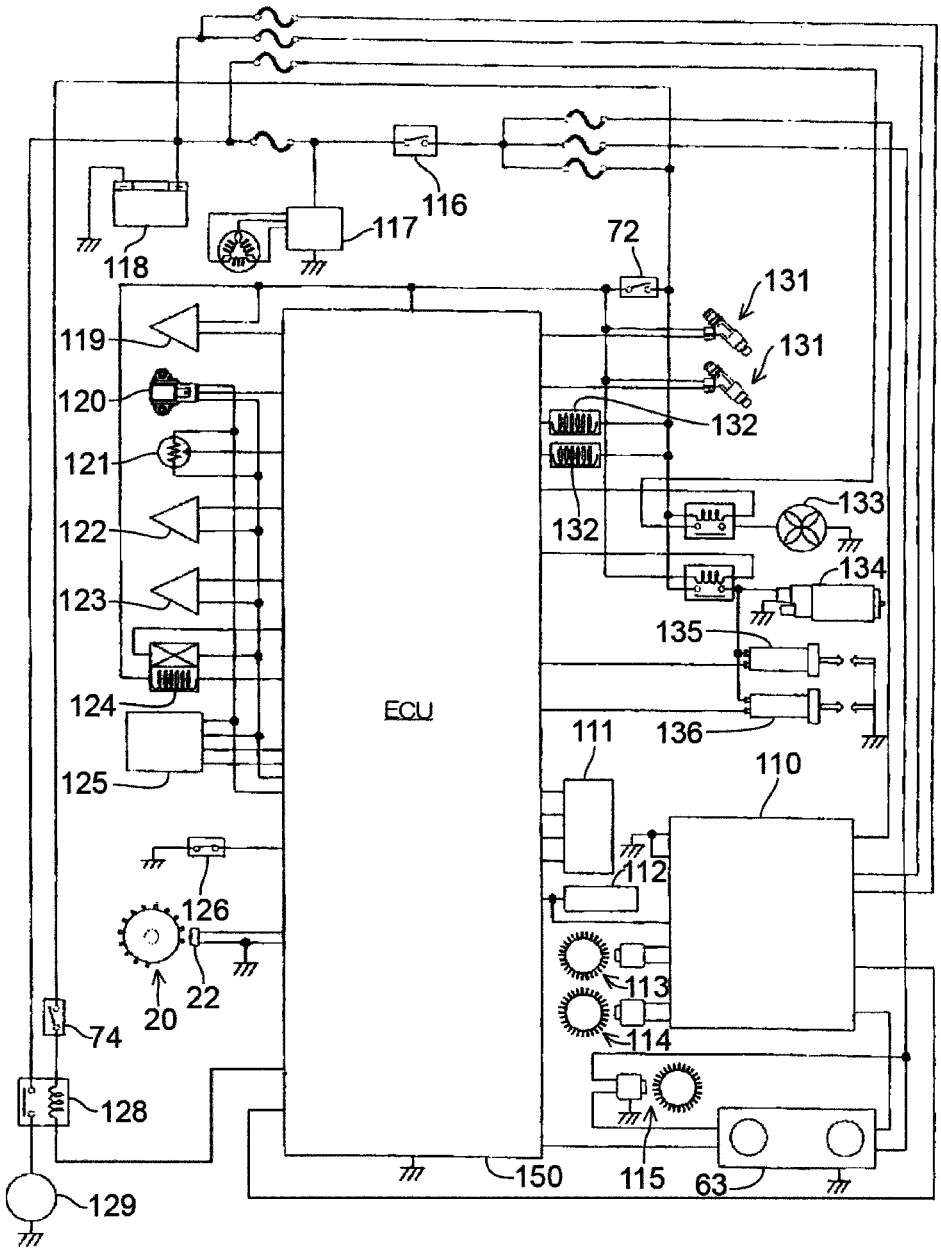
FIG. 3 is a block diagram showing the configuration of the whole system including the fuel injection control device.

FIG. 3 is a block diagram showing the configuration of the whole system including a fuel injection control device 150 according to the present embodiment. The fuel injection control device 150 is configured integrally with an ECU as an engine control unit, and the terms of the fuel injection control device and the ECU will be often used as synonymous terms hereinafter. A bank angle sensor 119 that detects the inclination angle of the vehicle body is connected to the ECU 150. Also connected to ECU 150 is an intake pressure sensor 120 that detects the pressure of the intake to the engine, and a throttle opening sensor 121 that detects the opening degree of the throttle valve, which changes in conjunction with operation of the throttle grip 69 (see FIG. 2). An outside air temperature sensor 122, a coolant temperature sensor 123 that detects the temperature of the engine coolant, an oxygen sensor 124 that detects the oxygen concentration in the exhaust gas, an immobilizer 125 that authenticates the ignition key, an oil pressure switch 126 that activates a warning light when the pressure of the lubricant path decreases, and a pulse generator 22 that detects the rotation state of the crank pulsar rotor 20 provided around the crankshaft of the engine 12, are also connected to ECU 150. The ECU 150 drives an injector 131 as a fuel injector (fuel injection device) and ignition systems 135 and 136 based on information of the respective sensors.

The ECU 150 is driven by power of an in-vehicle battery 118. To the downstream side of the in-vehicle battery 118, a regulator rectifier 117, an ignition switch 116, a starter switch 74, a starter motor 129, and a starter motor relay 128 are connected. An engine stop switch 72 is provided on the upstream side of the injector 131.

Furthermore, to the ECU 150, a catalytic device 132, an electric fan 133 of a radiator, a fuel pump 134, an idle air control valve 111 to adjust the intake amount in idling operation, a K-line connector 112 for information communication, and a meter unit 63 including a speedometer and a revolution indicator are connected. An ABS control device 110 that reduces the brake pressure based on information from wheel speed sensors 113 and 114 of the front and rear wheels is connected to the K-line connector 112. A vehicle speed sensor 115 that detects the rotational speed of the engine output shaft is connected to the meter unit 63.

Figure 4:
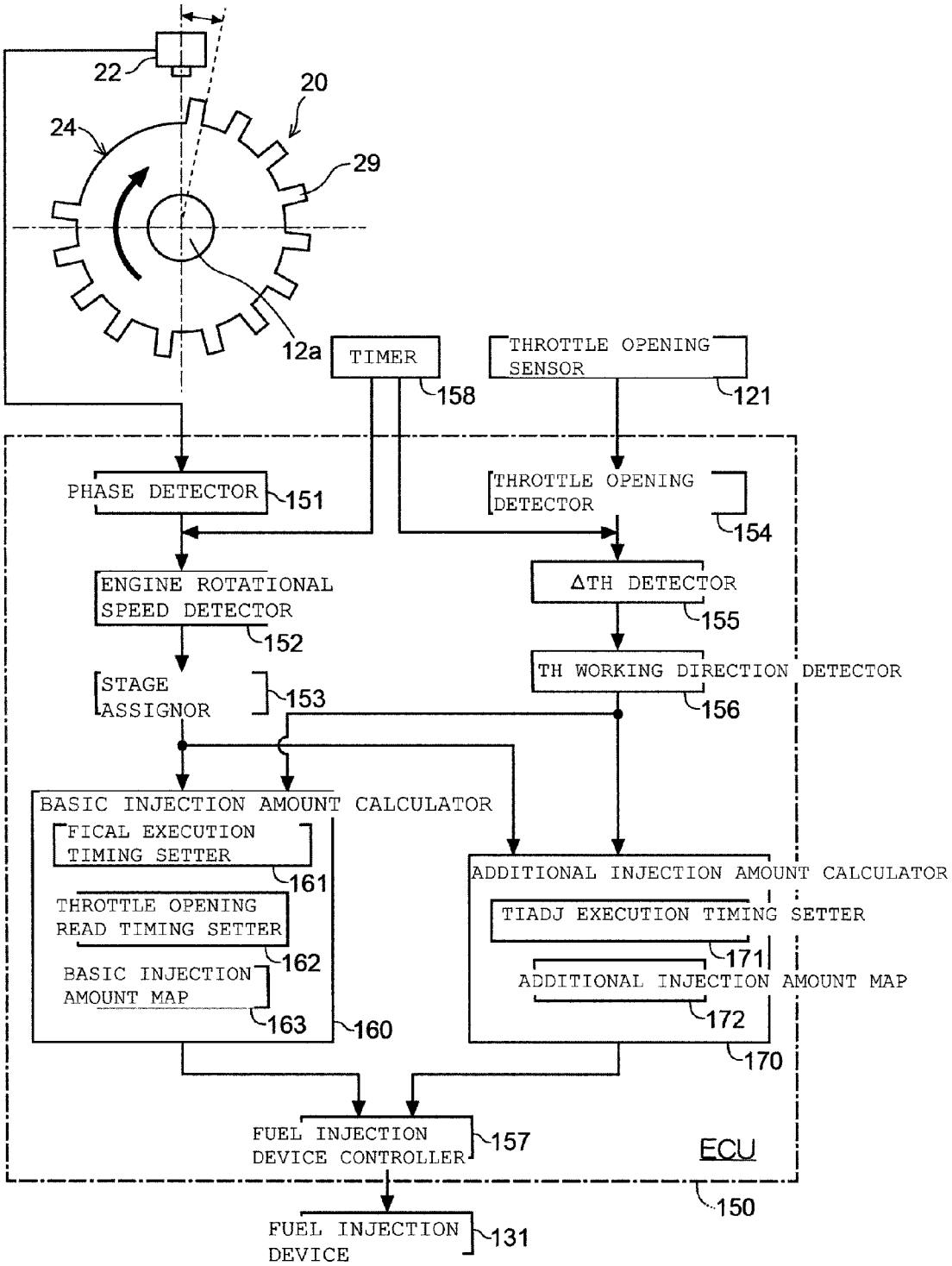
FIG. 4 is a block diagram showing the configuration of the fuel injection control device (ECU).

FIG. 4 is a block diagram showing the configuration of the fuel injection control device (ECU) 150. The crank pulsar rotor 20 in which thirteen protrusions 29 are made with the intermediary of a toothless part (toothless position) 24 regarding every one rotation thereof is attached to a crankshaft 12*a* of the engine 12, and the pulse generator 22 is provided near it. The thirteen protrusions 29 are disposed at intervals of 22.5 degrees and the center angle of the toothless part 24 is set to 90 degrees. A crank pulse generated by the pulse generator 22 is input to a phase detector 151 of the ECU 150.

The phase detector 151 detects the phase of the crankshaft 12*a* based on the crank pulse. An engine rotational speed detector 152 detects an engine rotational speed Ne based on phase information of the crankshaft and time information measured by a timer 158.

A stage assignor 153 divides one rotation of the crankshaft 12*a* into thirteen segments based on the output timing of the crank pulse and assigns stage counts of "0" to "13" (360-degree stages) to the respective phases of the crankshaft. Upon the completion of a stroke determination of the engine 12, the stage assignor 153 assigns absolute stages of "0" to "25" (720-degree stages) to the respective phases of one cycle of the crankshaft (720 degrees).

A throttle opening detector 154 detects the throttle opening based on a detection signal of the throttle opening sensor 121. A ΔTH detector 155 detects a change amount ΔTH of the throttle opening based on the throttle opening and the time information by the timer 158. Furthermore, a TH working direction detector 156 detects the open/close direction of the throttle based on the detection signal of the throttle opening sensor 121.

The fuel injection device 131 is driven by a control signal from a fuel injection device controller 157 in the ECU 150. The fuel injection device controller 157 decides the control signal of the fuel injection device 131 based on output signals from a basic injection amount calculator 160 and an additional injection amount calculator 170.

The basic injection amount calculator 160 applies the throttle opening detected by the throttle opening sensor 121 and the engine rotational speed detected by the engine rotational speed detector 152 to a basic injection amount map 163 to thereby calculate a basic injection amount in basic injection.

The additional injection amount calculator 170 applies the throttle opening and the engine rotational speed to an additional injection amount map 172 to thereby calculate an additional injection amount in additional injection performed subsequently to the basic injection. This additional injection serves as a correction amount when a predetermined change is caused in the throttle opening due to e.g. sudden acceleration.

The basic injection amount calculator 160 includes a FICAL execution timing setter 161 as the calculation timing decider, a throttle opening read timing setter 162, and the basic injection amount map 163. The FICAL execution timing setter 161 sets the execution timing of FICAL processing for calculating the basic injection amount based on information on the engine rotational speed Ne and the throttle opening.

Then, depending on the execution timing of FICAL, the throttle opening read timing setter 162 decides whether read processing of the throttle opening is to be executed at the detection timing of the crank pulse (crank pulse interrupt) or at the execution timing of FICAL defined based on the time (FICAL interrupt). The fuel injection control device 150 according to the present embodiment has a characteristic in that response delay when the throttle is rapidly opened in a specific driving state is prevented by the provision of this throttle opening read timing setter 162. Details thereof will be described later.

The additional injection amount calculator 170 includes a TIADJ execution timing setter 171 and an additional injection amount map 172. The TIADJ execution timing setter 171 sets the execution timing of TIADJ processing for calculating the additional fuel injection amount based on information on the engine rotational speed Ne, the throttle opening TH, and the change amount ΔTH of the throttle opening. The additional injection amount map 172 is so set that, the larger the throttle opening TH and the change amount ΔTH becomes, the larger the additional injection amount becomes.

Figure 5:
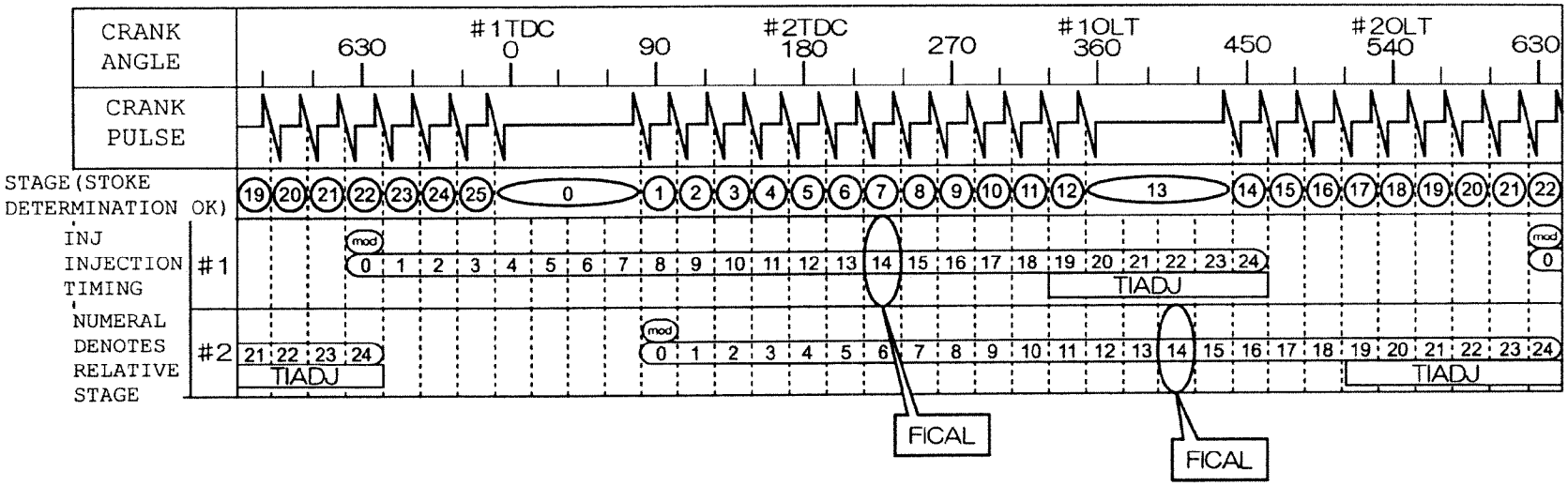
FIG. 5 is a time chart showing the flow of the operation of the fuel injection control device.

FIG. 5 is a time chart showing the flow of the operation of the fuel injection control device 150. The crank angle on the uppermost row shows the rotation angle of the crankshaft 12*a* from a predetermined angle. In the field of the crank angle, the positions of the compression top dead center (TDC) and the valve overlap top dead center (OLT) of the respective cylinders are shown. Under the crank angle, the crank pulse generated by the pulse generator 22 is shown.

Under the crank pulse, the absolute stages corresponding to the crank pulse (720-degree stages after the stroke determination is settled) are shown.

Furthermore, on rows of INJ (injection) injection timing, relative stages "0" to "24" defined by quartering the toothless part and representing the whole of one cycle by equal interval stages are shown for each of a first cylinder (#1) and a second cylinder (#2). In the field of this relative stage, the execution timings of a basic injection amount calculation stage (hereinafter, it will be often referred to simply as FICAL) and an additional injection amount calculation stage (hereinafter, it will be often referred to simply as TIADJ) are each shown.

In the present embodiment, the setting is so made that injection with the basic injection amount is executed from the stage next to the execution stage of FICAL. This injection amount can be set based on the time for which the on-state of energization of the fuel injection device 131 is continued. On the other hand, if the request amount of the fuel is rapidly increased due to e.g. sudden acceleration, an additional injection amount is calculated in TIADJ after FICAL, and injection is performed with this amount, which enables acceleration correction.

The execution timings of FICAL and TIADJ are adjusted to earlier or later timing in the range of several stages depending on the engine rotational speed and the throttle opening so that fuel atomization may be optimized. In this diagram, TIADJ has a predetermined width (equivalent to six stages). This shows the movement allowable range of the TIADJ as such a range that the injected fuel can be sucked into the combustion chamber in the same cycle. Similarly, FICAL also has an adjustment allowable width equivalent to several stages (e.g. two or three stages) depending on the operation state of the engine. In the example of this diagram, the state in which FICAL is set at the 14th stage for both the first and second cylinders is shown.

In this case, FICAL of the first cylinder is at the position corresponding to "7" of the absolute stage, whereas FICAL of the second cylinder is at the position corresponding to "13" of the absolute stage. That is, the FICAL of the second cylinder falls on the position corresponding to the toothless part 24 of the crank pulsar rotor 20 (toothless position).

Normally, the detection processing of the throttle opening by the throttle opening detector 154 (see FIG. 4) is triggered by input of the crank pulse, which serves as a sure input signal, and is executed for each crank pulse (crank pulse interrupt). In contrast, the execution timing of FICAL is set based on time interrupt anticipated from the operation state of the previous cycle in order to avoid a sudden change of the injection start timing. Due to this, if the engine 12 has plural cylinders, FICAL often falls on the toothless position and the movement thereof to earlier or later timing in the range of the toothless position also occurs. At this time, if the setting in which the detection processing of the throttle opening is executed based on the crank pulse interrupt is still employed, when the throttle opening changes at the toothless position, this change cannot be detected.

Figure 6:
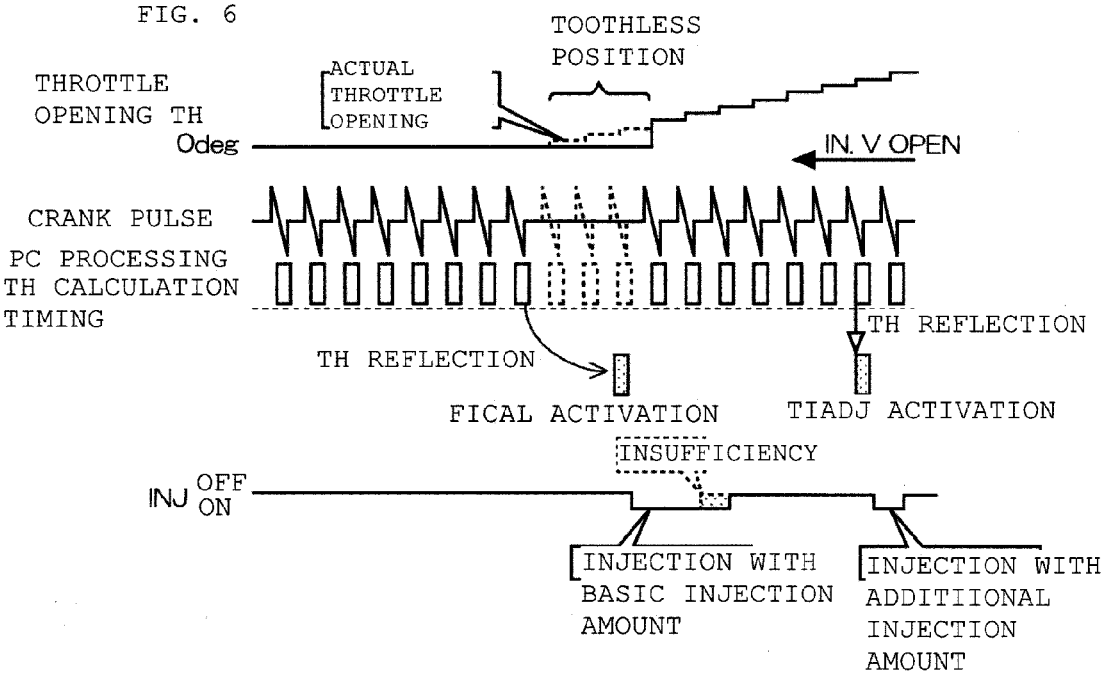
FIG. 6 is a graph showing the relationship between a crank pulse and throttle opening detection timing.

FIG. 6 is a graph showing the relationship between the crank pulse and the throttle opening detection timing. As described above, in the case of employing the setting in which the execution timing of FICAL is set based on the time interrupt and the detection processing of the throttle opening is executed based on the crank pulse interrupt, when FICAL is activated at the toothless position, the latest throttle opening information cannot be reflected in this FICAL because the throttle opening cannot be detected during the period corresponding to the toothless position.

Specifically, in the example shown in FIG. 5, in calculation of the basic fuel injection amount by FICAL activated at the relative stage "14" of the second cylinder, the throttle opening information that can be applied to it is old information obtained before the relative stage "12." Thus, even when the throttle is rapidly opened after an entry to the toothless position, this opening change is ignored. Referring to FIG. 6 in combination, even in the case in which the "actual throttle opening" increases as shown by the dashed line simultaneously with an entry to the toothless position, this increase is not reflected in the FICAL and the influence of "insufficiency" is left in the basic injection amount. This influence is not considered also in calculation of the additional correction amount by the TIADJ subsequent to the FICAL (it cannot be considered because the change in the throttle opening is not detected). This causes the possibility of the occurrence of the "lean spike phenomenon," in which the air-fuel mixture temporarily becomes lean and the engine power decreases, in the next cycle.

So, in the fuel injection control device 150 according to the present embodiment, the setting is so made that, although reading the throttle opening based on the crank pulse interrupt in normal time, the throttle opening read timing setter 162 is triggered to read the throttle opening by activation of FICAL when the FICAL is activated at the toothless position. This allows a change in the throttle opening to be reflected in the FICAL even when the change is caused at the toothless position. The fuel injection control device 150 has a characteristic in this point.

Figure 7:
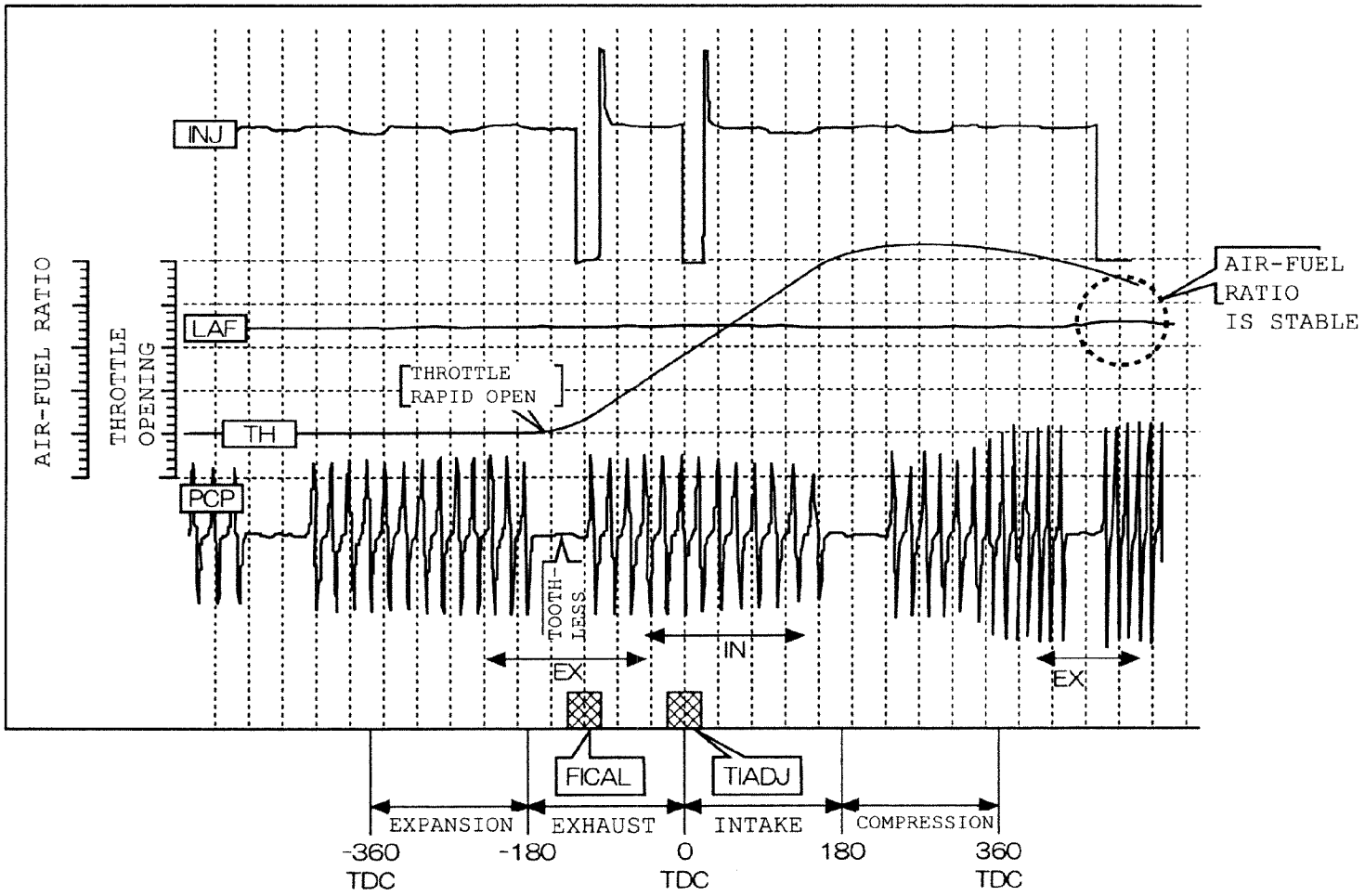
FIG. 7 is a graph showing the influence on the air-fuel ratio when a change in the throttle opening is caused at a toothless position (embodiment).
Figure 10:
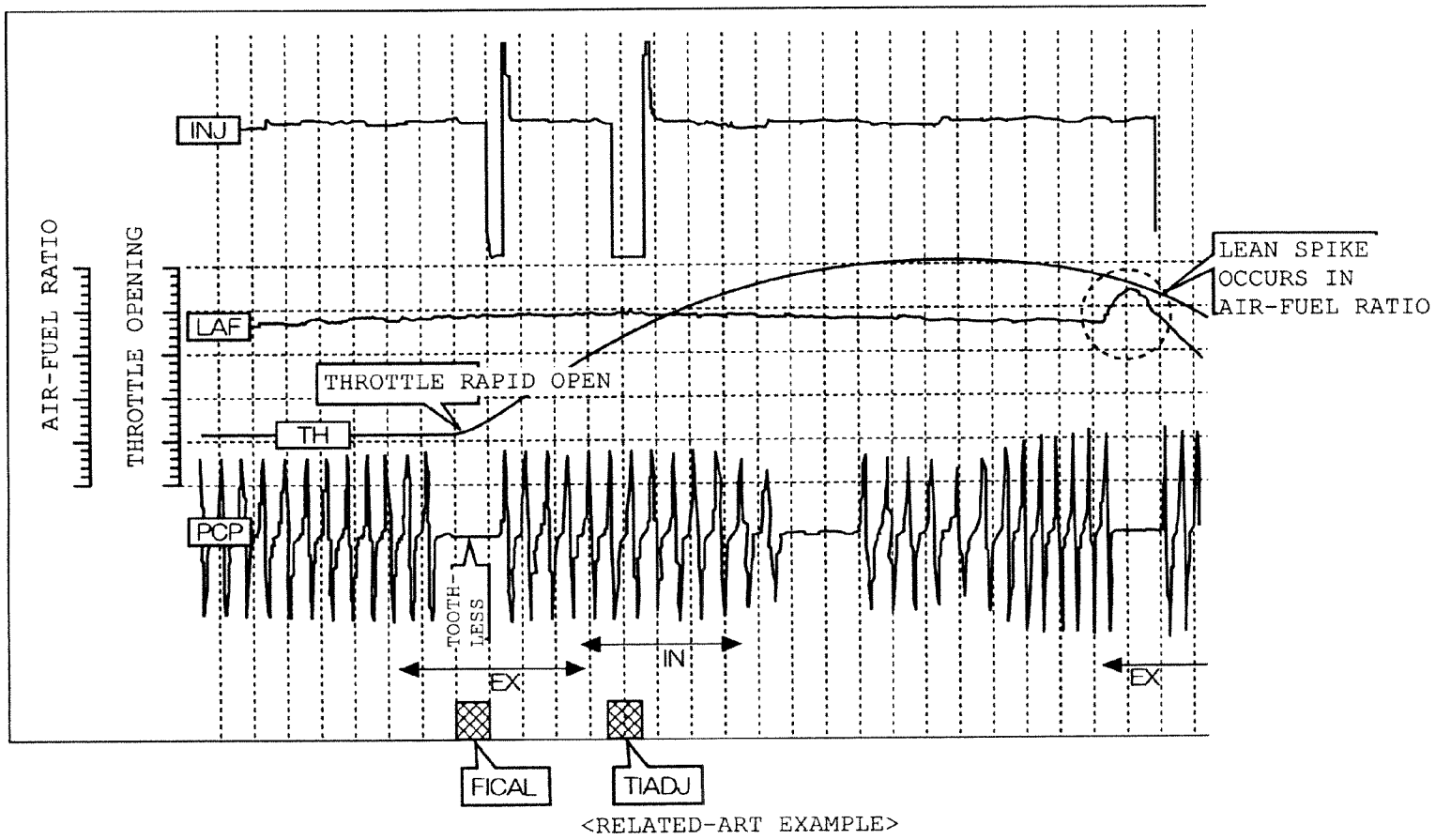
FIG. 10 is a graph showing the influence on the air-fuel ratio when a change in the throttle opening is caused at the toothless position (related-art example).

FIGS. 7 and 10 are graphs showing the influence on the air-fuel ratio when a change in the throttle opening is caused at the toothless position. FIG. 7 shows the case of the present embodiment in which the throttle opening is read in association with activation of FICAL. FIG. 10 shows the case of a related-art example in which the throttle opening is read only based on the crank pulse interrupt.

In both graphs, the following elements are shown from the uppermost row: a drive signal (INJ) of the fuel injection device 131; an output signal (LAF) of the oxygen sensor (air-fuel ratio sensor) 124; an output signal (TH) of the throttle opening sensor 121; the crank pulse (PCP); the open period (EX) of the exhaust valve; and the open period (IN) of the intake valve.

The drive signal (INJ) of the fuel injection device 131 shows the operation timing of the fuel injection device 131 that is so set as to continue injection under constant pressure during the on-state of energization, which is represented by the downward projecting waveform in the graph, and stop the injection in response to turning-off of the energization. The output signal (TH) of the throttle opening sensor is so set that the output level increases as the throttle opening increases.

In the related-art example of FIG. 10, due to the influence of rapid opening of the throttle at the toothless position, the lean spike phenomenon, in which the air-fuel ratio temporarily becomes lean, occurs in the next cycle. The occurrence of this lean spike causes the possibility of the occurrence of temporary lowering of the engine power that is not intended by the rider. In contrast, in the example of the present embodiment shown in FIG. 7, the influence of rapid opening of the throttle at the toothless position on the air-fuel ratio is suppressed to the minimum, and a stable air-fuel ratio can be obtained.

As shown in FIG. 7, the FICAL is set at a position previous to TIADJ set in the intake stroke of the engine 12. In addition, the FICAL is set at such a position that the injection with the basic injection amount calculated by this FICAL is completed by the start time of the TIADJ. This is because the setting range of the FICAL is defined based on data obtained by e.g. experiment in advance so that the injected fuel may be smoothly sucked into the cylinder. Due to this, the calculation timing can be figured out at proper timing according to the operation state of the engine. Furthermore, overlapping of injection orders with the basic injection amount and the additional injection amount is also avoided.

Figure 8:
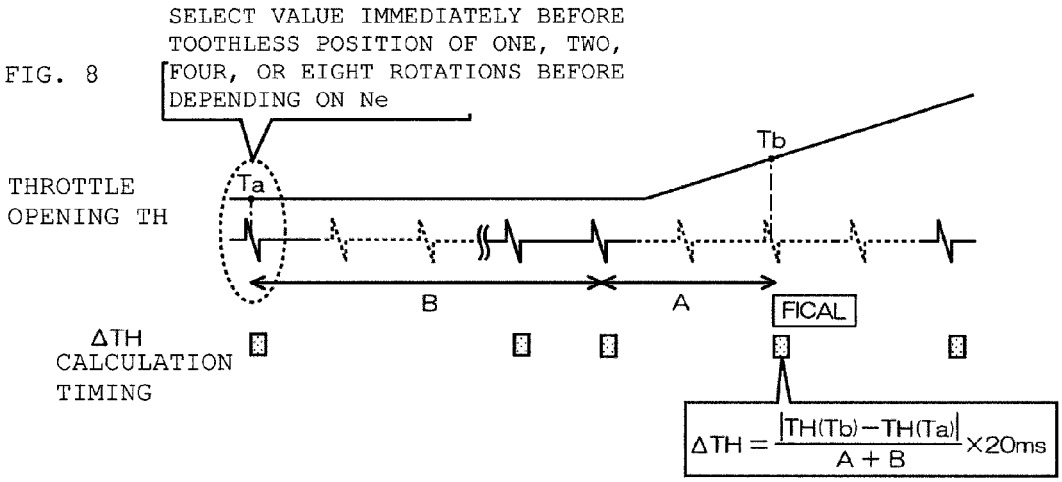
FIG. 8 is a graph showing TH and a method for calculating ΔTH when FICAL is activated at the toothless position.

FIG. 8 is a graph showing the throttle opening TH and a method for calculating the change amount ΔTH of the throttle opening when FICAL is activated at the toothless position. If FICAL is activated at the toothless position, the fuel injection control device 150 employs the throttle opening TH, the change amount ΔTH, and the throttle working direction (open/close direction) detected and calculated in association with the activation of the FICAL as parameters in calculation of the basic injection amount in the FICAL.

The change amount ΔTH is calculated by using the throttle opening TH(Tb) detected in response to the activation of the FICAL as the trigger and the throttle opening TH(Ta) detected by the crank pulse immediately before the toothless position of one, two, four, or eight rotations before depending on the engine rotational speed. Specifically, it is calculated by a calculation expression of $\Delta TH=\{|TH(Tb)-TH(Ta)|\div(A+B)\}\times 20$ ms. In this expression, A is the time from the crank pulse immediately before the present toothless position to the FICAL. B is the time from the crank pulse immediately before the toothless position of one, two, four, or eight rotations before to the crank pulse immediately before the present toothless position.

When the change amount ΔTH is calculated based on the crank pulse interrupt, the change amount ΔTH is calculated by comparison with the previous value every crank pulse interrupt, and peak hold is carried out between adjacent FICAL. Then, if the change amount ΔTH calculated based on the above-described FICAL interrupt is larger than this change amount ΔTH subjected to the peak hold, the newly calculated change amount ΔTH is used for calculation of the basic injection amount (conversely, if it is smaller, the basic injection amount is calculated by using the peak hold value).

The throttle operation speed by the human is at most 6 Hz (cycle is about 167 ms), whereas the maximum time it takes for the toothless position to pass is about 16 ms when the engine rotational speed Ne is 1000 rpm. Thus, sufficient linearity exists in the trajectory of the throttle opening TH at the toothless position, and it can be said that correction into which the change in the throttle opening is reflected is sufficiently possible if the change amount ΔTH associated with FICAL is calculated.

In the above-described embodiment, the case in which FICAL is activated at the toothless position is shown. However, if TIADJ is activated at the toothless position, the configuration can be so made that detection of the throttle opening TH is triggered by the activation of the TIADJ.

Figure 9:
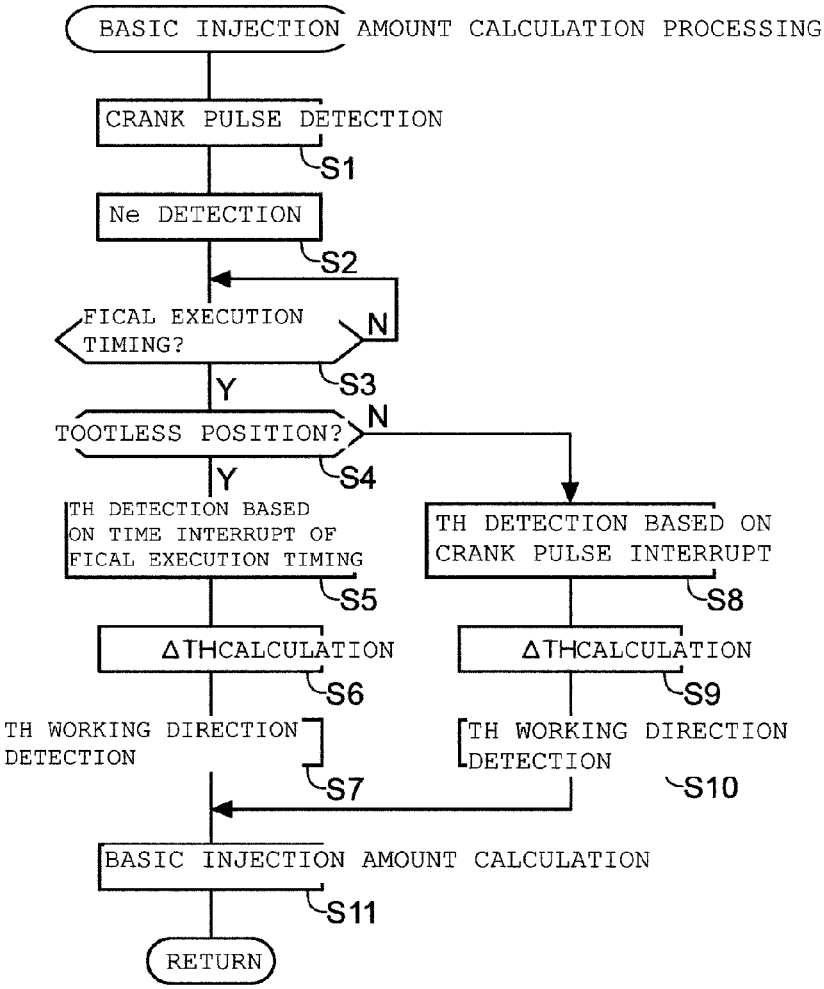
FIG. 9 is a flowchart showing the procedure of basic injection amount calculation processing according to embodiments of the invention.

FIG. 9 is a flowchart showing the procedure of basic injection amount calculation processing according to the present embodiment. In a step S1, the crank pulse is detected by the phase detector 151 (see FIG. 4). In the subsequent step S2, the engine rotational speed Ne is detected by the engine rotational speed detector 152. In a step S3, whether or not the present timing is the execution timing of FICAL (basic injection amount execution stage) is determined based on information on the engine rotational speed Ne, the throttle opening TH, and so forth. This determination is executed by the FICAL execution timing setter 161. The processing proceeds to a step S4 if the positive determination is made in the step S3, whereas the processing returns to the determination of the step S3 if the negative determination is made.

In the step S4, it is determined by the throttle opening read timing setter 162 whether or not the present position on the crank pulsar rotor 20 opposed to the pulse generator 22 is the toothless position. If the positive determination is made in the step S4, i.e. if it is determined that the present position is at the toothless position, the processing proceeds to a step S5. In the step S5, the throttle opening TH is detected based on the time interrupt of the FICAL execution timing. In the subsequent step S6, the change amount ΔTH of the throttle opening TH by the calculation procedure shown in FIG. 8 is calculated by the ΔTH detector 155. In a step S7, the working direction of the throttle is detected by the TH working direction detector 156. Then, in a step S11, the basic injection amount is calculated based on the information detected in the steps S5, S6, and S7, so that the series of control is ended.

On the other hand, if the negative determination is made in the step S4, i.e. if it is determined that the present position is not at the toothless position and hence at such a position that crank pulse interrupt is possible, the processing proceeds to a step S8 and the throttle opening TH is detected based on the crank pulse interrupt. In the subsequent step S9, the change amount ΔTH is calculated by comparison with the throttle opening detected by the immediately previous crank pulse interrupt. In a step S10, the working direction of the throttle is detected. Then, the basic injection amount is calculated based on these values in the step S11, so that the series of control is ended.

As described above, according to the fuel injection control device of the saddle-ride type vehicle according to embodiments of the present invention, if the calculation timing of the basic injection amount (FICAL) is at the position corresponding to the toothless part 24 of the crank pulsar rotor 20, detection of the throttle opening TH used for calculation of the basic injection amount is triggered by the start of the FICAL. Therefore, the latest throttle opening can be detected even when FICAL is activated at the toothless position. Thus, an acceleration request by the driver can be rapidly reflected without causing increase in the number of parts for example. On the other hand, if FICAL is at a position other than the position corresponding to the toothless part 24, the throttle opening TH is detected based on the crank pulse interrupt according to the crank pulse. Therefore, in normal time, detection of the throttle opening is triggered by input of the crank pulse, which serves as a sure input signal. This makes it possible to rapidly reflect an acceleration request whatever situation the calculation timing is in.

The number of cylinders in the engine, the type of the engine, the shape and configuration of the crank pulsar rotor, the waveform of the crank pulse, the open/close timing of the intake and exhaust valves, the number and configuration of injectors, the configuration in the ECU (fuel injection control device), and so forth are not limited to the above-described embodiment, and various changes are possible. The fuel injection control device according to the embodiment of the present invention is not limited to the two-wheeled motor vehicle and can be applied to various kinds of saddle-ridden engine vehicles such as three-/four-wheeled vehicles.

DESCRIPTION OF REFERENCE SYMBOLS

10 . . . Two-wheeled motor vehicle, 12 . . . Engine, 20 . . . Crank pulsar rotor, 24 . . . Toothless part (toothless position), 29 . . . Protrusion, 121 . . . Throttle opening sensor, 131 . . . Fuel injection device (injector), 150 . . . Fuel injection control device (ECU), 152 . . . Engine rotational speed detector, 153 . . . Stage assignor, 151 . . . Phase detector, 154 . . . Throttle opening detector, 155 . . . ΔTH detector, 156 . . . TH working direction detector, 157 . . . Fuel injection device controller, 158 . . . Timer, 160 . . . Basic injection amount calculator, 161 . . . FICAL execution timing setter, 162 . . . Throttle opening read timing setter, 163 . . . Basic injection amount map, 170 . . . Additional injection amount calculator, 171 . . . TIADJ execution timing setter, 172 . . . Additional injection amount map, FICAL . . . Calculation timing of basic injection amount, TIADJ . . . Calculation timing of additional injection amount

The invention claimed is:

1. A vehicle, comprising:

a throttle opening detector configured to detect a throttle opening changing in conjunction with operation of a rider;

a crank pulsar rotor provided around a crankshaft and having detection-target teeth disposed at equal intervals and a toothless part;

a pulse generator configured to generate a crank pulse according to a passage state of the detection-target teeth;

an engine rotational speed detector configured to detect the crank pulse to detect a rotational speed of an engine;

a fuel injector configured to inject a fuel into an intake path of the engine;

a basic injection amount calculator configured to calculate a basic injection amount based on the engine rotational speed and the throttle opening, an additional injection amount calculator configured to superimpose an additional injection amount on the basic injection amount based on a change amount of the throttle opening;

a calculation timing decider configured to decide calculation timing of the basic injection amount based on the engine rotational speed and the throttle opening, and a fuel injection control device, said fuel injection control device comprising a throttle opening read timing setter configured to set timing at which the throttle opening is read, wherein the throttle opening read timing setter is configured to be triggered to detect the throttle opening used for calculation of the basic injection amount by activation of the calculation of the basic injection amount if the calculation timing of the basic injection amount is at a position corresponding to the toothless part, wherein if the engine has at least two cylinders, the throttle opening read timing setter is triggered to detect the throttle opening by activation of the calculation of the basic injection amount for the cylinder in which the calculation timing of the basic injection amount is at a position corresponding to the toothless part, and to detect the throttle opening based on crank pulse interrupt according to the crank pulse for the cylinder in which the calculation timing of the basic injection amount is at a position other than the position corresponding to the toothless part.

2. The vehicle according to claim 1, wherein the throttle opening read timing setter is configured to detect the throttle opening based on crank pulse interrupt according to the crank pulse if the calculation timing of the basic injection amount is at a position other than the position corresponding to the toothless part.

3. The vehicle according to claim 1, wherein the calculation timing of the basic injection amount is set to timing that is before calculation timing of the additional injection amount set in an intake stroke of the engine and is in such a range that injection with the basic injection amount is completed by start time of the calculation timing of the additional injection amount.

4. The vehicle according to claim 1, wherein the additional injection amount calculator is configured to set the additional injection amount larger when the change amount of the throttle opening is larger.

5. A vehicle, comprising:

throttle opening detector means for detecting a throttle opening changing in conjunction with operation of a rider;

crank pulsar rotor means provided around a crankshaft and having detection-target teeth disposed at equal intervals and a toothless part;

pulse generator means for generating a crank pulse according to a passage state of the detection-target teeth;

engine rotational speed detector means for detecting the crank pulse to detect a rotational speed of an engine;

fuel injector means for injecting a fuel into an intake path of the engine;

basic injection amount calculator means for calculating a basic injection amount based on the engine rotational speed and the throttle opening, additional injection amount calculator means for superimposing an additional injection amount on the basic injection amount based on a change amount of the throttle opening;

calculation timing decider means for deciding calculation timing of the basic injection amount based on the engine rotational speed and the throttle opening, and fuel injection control means for controlling fuel injection, said fuel injection control means comprising throttle opening read timing setting means for setting timing at which the throttle opening is read, wherein the throttle opening read timing setting means is triggered to detect the throttle opening used for calculation of the basic injection amount by activation of the calculation of the basic injection amount if the calculation timing of the basic injection amount is at a position corresponding to the toothless part, wherein if the engine has at least two cylinders, the throttle opening read timing setting means is triggered to detect the throttle opening by activation of the calculation of the basic injection amount for the cylinder in which the calculation timing of the basic injection amount is at a position corresponding to the toothless part, and to detect the throttle opening based on crank pulse interrupt according to the crank pulse for the cylinder in which the calculation timing of the basic injection amount is at a position other than the position corresponding to the toothless part.

6. The vehicle according to claim 5, wherein the throttle opening read timing setting means is also for detecting the throttle opening based on crank pulse interrupt according to the crank pulse if the calculation timing of the basic injection amount is at a position other than the position corresponding to the toothless part.

7. The vehicle according to claim 5, wherein the calculation timing of the basic injection amount is set to timing that is before calculation timing of the additional injection amount set in an intake stroke of the engine and is in such a range that injection with the basic injection amount is completed by start time of the calculation timing of the additional injection amount.

8. The vehicle according to claim 5, wherein additional injection amount calculator means is also for setting the additional injection amount larger when the change amount of the throttle opening is larger.

* * * * *